United States Patent [19]

Calari

[11] Patent Number: 5,064,358

[45] Date of Patent: Nov. 12, 1991

[54] PERISTALTIC PUMP ADAPTED TO OPERATE SIMULTANEOUSLY ON TWO LINES

[76] Inventor: Alessandro Calari, Via Trieste, 8, Mirandola (Modena), Italy

[21] Appl. No.: 366,042

[22] Filed: Jun. 13, 1989

[30] Foreign Application Priority Data

Jun. 14, 1988 [IT] Italy ..... 20961 A/88

[51] Int. Cl.[5] ..... F04B 43/08

[52] U.S. Cl. ..... 417/475; 417/477; 604/153

[58] Field of Search ..... 417/474, 475, 476, 477; 604/153

[56] References Cited

U.S. PATENT DOCUMENTS

| | | | |
|---|---|---|---|
| 2,332,157 | 10/1943 | Mapson | 417/475 X |
| 3,303,748 | 2/1967 | Duryee et al. | 417/477 |
| 3,429,273 | 2/1969 | Jones, Jr. | 417/475 |
| 3,431,864 | 3/1969 | Jones, Jr. | 417/475 |
| 3,723,030 | 3/1973 | Gelfand | 417/477 X |
| 3,737,251 | 6/1973 | Berman et al. | 417/475 |
| 3,791,777 | 2/1974 | Papoff et al. | 417/475 |
| 4,012,176 | 3/1977 | Drori | 417/475 |
| 4,060,348 | 11/1977 | Bianca | 417/475 |
| 4,132,509 | 1/1979 | Bongartz et al. | 417/475 |
| 4,586,882 | 5/1986 | Tseng | 417/477 |
| 4,886,431 | 12/1989 | Soderquist et al. | 417/477 |

FOREIGN PATENT DOCUMENTS

| | | | |
|---|---|---|---|
| 60-230582 | 11/1985 | Japan | 417/475 |
| 0881365 | 11/1981 | U.S.S.R. | 417/475 |
| 2173549 | 3/1985 | United Kingdom | 417/477 |

*Primary Examiner*—Richard A. Bertsch
*Assistant Examiner*—Michael I. Kocharov
*Attorney, Agent, or Firm*—P. C. Richardson; L. C. Akers; R. C. Turner

[57] ABSTRACT

A peristaltic pump is described for operating simultaneously on two fluid lines having different wall thicknesses comprising a rotatable head having rollers and enclosed within a hollow body. The hollow body has a central axis with an internal first cylindrical surface portion at a first radius R from the axis, and a second cylindrical surface portion at a second radius r from the axis. The interspace between the periphery of the respective roller and the respective cylindrical surface portion is arranged to perfectly occlude the respective different sized fluid line.

1 Claim, 2 Drawing Sheets

11
9a
9b
20
9
4a
4b
6
5
6
I
4
4b
19
13
12
15
17
16
18

10
10a
10b
2a
2
12
7b
1
R
r
4a
4
3
6
11
3a
9a
9b
9

PERISTALTIC PUMP ADAPTED TO OPERATE SIMULTANEOUSLY ON TWO LINES

BACKGROUND OF THE INVENTION

The invention relates to a peristaltic pump adapted to operate simultaneously on two lines.

As known, peristaltic pumps comprise a rotatable head provided with rollers adapted to compress at lease one fluid conveyance line made of flexible material, such as PVC, silicon, or polyurethane, against portions of a cylindrical resting surface in the fixed body of the pump. For efficient operation of the pump, the rollers exert pressure which provides perfect occlusion of the flexible line, and the pumps are provided with critical means of adjustment.

Typically, use is made of these pumps in the medical field, for example for infusing drugs, or in extracorporeal blood circuits. It often occurs that a peristaltic pump has to operate simultaneously on two lines which must convey different flows of fluid in a precisely determined ratio, as required for example in the case of the simultaneous conveyance of blood in one line and of anticoagulant liquid in the other. The required ratio between the flow rates of the two fluids is achieved by an appropriate choice of the passage areas of the respective lines. However, an operator having a known type of peristaltic pump available encounters serious limitations. In known pumps, the two portions of cylindrical resting surfaces of the two lines have the same radius of curvature and therefore it is necessary to employ lines with different passage areas but having the same wall thickness to obtain their perfect occlusion.

The provision of such lines is always difficult, and it is thus an aim of the present invention to provide a peristaltic pump which is adapted to efficiently operate simultaneously on two lines, without requiring that the two lines necessarily have the same wall thickness.

SUMMARY OF THE INVENTION

The present invention discloses a peristaltic pump adapted to operate simultaneously on two different sized flexible fluid carrying lines, having different wall thicknesses, and includes a fixed hollow body having a central axis and an interior with a first cylindrically shaped wall surface portion at a first radius R from the central axis, and a second cylindrically shaped wall surface portion at a second radius r from the central axis, and having at least one opening therein adapted to receive a first sized fluid line along the first wall surface and a second sized fluid line along the second wall surface. The pump further includes a rotatable head having a generally cylindrically shaped periphery and arranged to be rotatable about the central axis within said hollow body. The rotatable head includes at least one roller arranged to be rotatable about an axis parallel to the central axis near the periphery of said rotatable head with a portion of the periphery of said roller extending beyond the periphery of said rotatable head and adapted to define a circular rolling path for progressively compressing the respective first sized fluid line and the second sized fluid line to simultaneously pump fluid through the respective lines.

DETAILED DESCRIPTION OF THE INVENTION

Further features and advantages of the invention will become apparent from the description of a preferred but not exclusive embodiment thereof, shown in the accompanying illustrative, non-limitative drawings, wherein.

Figure 2:
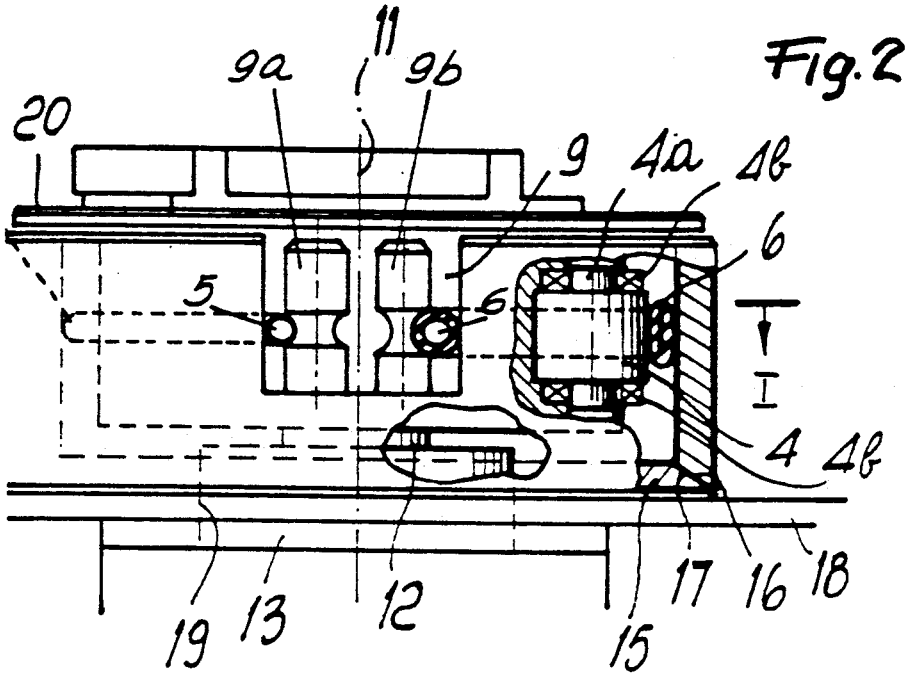
FIG. 2 is a front elevational view (shown partially in section) of the pump according to the invention.
Figure 1:
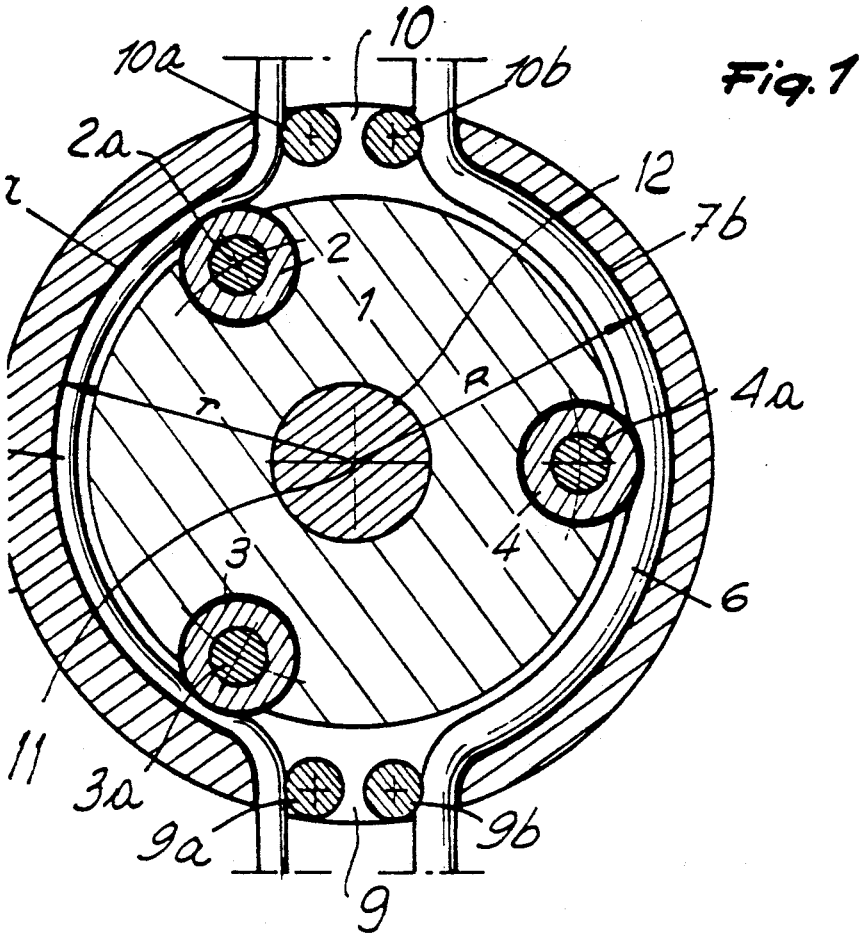
FIG. 1 is a sectional schematic plan view of the pump, taken along the line I—I of FIG. 2.

With reference to the above described figures, a peristaltic pump has a rotatable head 1, rotatable within a hollow generally cylindrically shaped fixed body 8 which, in the embodiment of FIGS. 1 and 2, is provided with a first semi-cylindrical internal surface 7*a* and a second semi-cylindrical internal surface 7*b* arranged coaxially with respect to rotation axis 11 of the rotatable head 1. The pump is provided with openings 9 and 10, which are adapted to receive the flexible lines 5 and 6.

As shown in FIG. 2, the body 8 is supported on a fixed supporting ring 15 having a bevelled peripheral edge 16 wherewith a complementary bevelled edge 17 of the body 8 is engaged and centered by virtue of the mating conical surfaces 16 and 17.

The body 8 is covered by a removable lid 20 and is fixed on the ring 15 by fasteners (not shown).

The supporting ring 15 is fixed on a base plate 18 having an aperture 19 through which a gear wheel transmission assembly 13, coupled to a drive motor (not shown) extends internally into the body 8. The rotatable head 1 is keyed to a shaft 12 of the transmission assembly 13, schematically illustrated in FIG. 1, such that rotation of the shaft 12 transmits rotational movement to the rotatable head. Alternatively, the shaft 12 may be rotatably driven directly by a suitable electric drive motor without the transmission assembly.

The rotatable head 1 includes rollers 2, 3, 4, supported by pins 2*a*, 3*a*, and 4*a* through suitable bearings illustrated as 4*b* in FIG. 2. The roller assemblies are positioned within hollow seats provided in the body of the head 1 near the peripheral surface. The axes of the rollers are parallel to the rotation axis 11 of the rotatable head 1. The rollers are arranged with a portion of the periphery of the roller extending beyond the peripheral surface of the rotatable head so as to define a circular rolling path for progressively compressing the flexible lines 5 and 6 to force the movement of fluid within the respective lines.

Positioning elements 9*a*, 9*b* and 10*a*, 10*b* are provided proximate to each opening 9 and 10, respectively, and have the function of aligning the lines 5 and 6. The lines are arranged between the surfaces 7*a* and 7*b* of the fixed body 8 and the surface of the protruding portions of the various rollers 2, 3, and 4.

The flexible lines 5 and 6 are typically made of a suitable plastic material, and in the instant case having different external diameters.

The rollers 2, 3, and 4 define, during rotation of the rotatable head 1, a first interspace between the first surface 7*a* and the peripheral surface of each roller, and a second interspace between the second surface 7*b* and the peripheral surface of each roller. Advantageously, the first interspace has a cross-sectional thickness which is different that the cross-sectional thickness of the second interspace. In the first embodiment illustrated in FIGS. 1 and 2, the surface *7a* has a radius of curvature r which, when referred to the rotation axis of the rotatable head 1, is smaller than the analogous radius of curvature R of the surface *7b*. In this manner the interspace between the surface *7a* and one of the rollers is smaller than the interspace between the surface *7b* and each roller. Thus, the flexible line 5 which is of smaller diameter is positioned along the surface *7a* of smaller radius r while the flexible line 6 which is of greater diameter is positioned along the surface *7b* with greater radius R.

It should be noted that the respective distances between surfaces *7a* and *7b* from the periphery of the head 1, should be sufficient to permit the free diameters of the respective lines 5 and 6. Also, the difference between the radius r of the surface *7a* and the distance of the peripheral surface of the rollers 2, 3, and 4 from the rotational axis 11 must be precisely controlled (about twice the wall thickness) to perfectly occlude the line 5; analogous considerations must be applied for the surface *7b* and the line 6.

Advantageously, in this first embodiment a plurality of fixed bodies 8 may be provided, having internal surfaces *7a*, *7b*, (*7c*, etc.) defining radii R, r, ($r^1$,etc.) which differ with respect to each other and the relative rotatable rollers so as to be able to employ flexible lines with different cross-sections in various combinations.

As may be noted in FIGS. 1 and 2, the openings 9 and 10 are provided by removing portions from the peripheral wall of the cylindrical body 8. This allows easy inspection during operation of the pump and, facilitates removal of the body 8 when one size is replaced by a body 8 of another size. The body 8 is easily removed by an axial displacement and is easily centered by virtue of the conical surfaces 16, 17.

Figure 3:
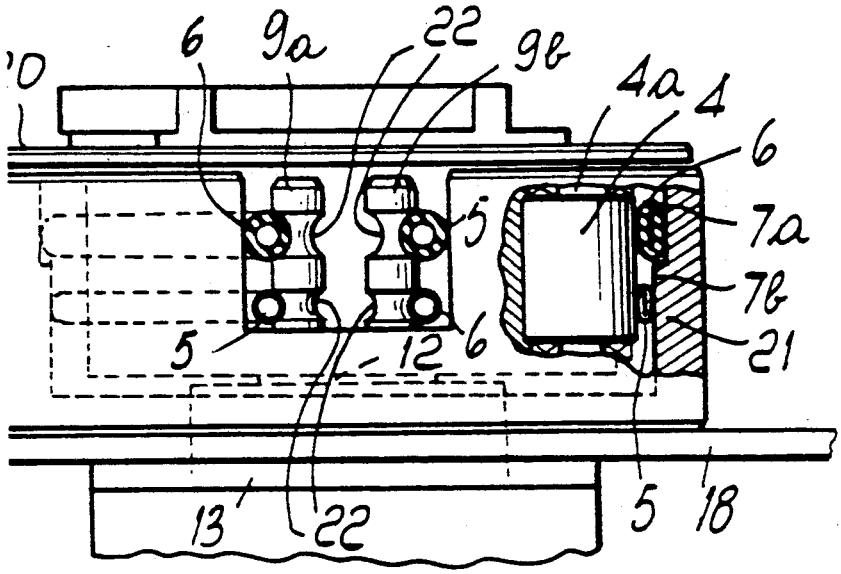
FIG. 3 is a front elevational view (shown partially in Section) of a different embodiment of the pump wherein the two lines are arranged adjacently.

In a second embodiment illustrated in FIG. 3, the peristaltic pump has the surfaces *7a* and *7b* arranged in an adjacent manner. In this embodiment, the two lines 5 and 6 enter and exit from the pump through the same opening such as 9 or 10 and are arranged adjacently and extend along most of the hollow body 8 and the peripheral surface of the rotatable head 1. The radius r of curvature of the surface *7a* with respect to the rotation axis 11 will be smaller than the radius of curvature R of the surface *7b* according to the different wall thicknesses of the respective lines 5 and 6, as defined by a transition portion 21. Obviously in this case the rollers 2, 3 and 4 still have a cylindrical configuration while the abutment elements *9a* and *9b* or *10a* and *10b* have two adjacent cavities 22, defining different radii of curvature according to the external diameter of the lines 5 and 6.

Figure 4:
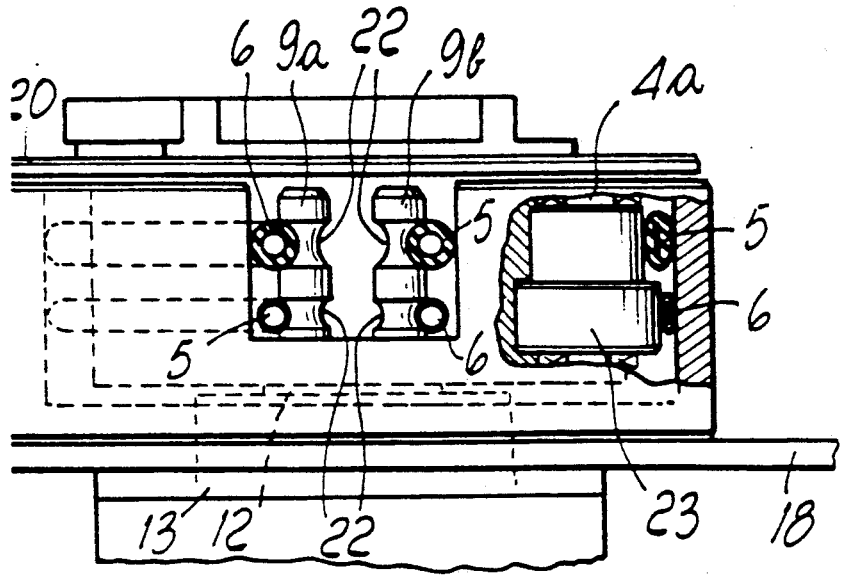
FIG. 4 is a front elevational view (shown partially in section) of a further embodiment of the pump wherein, as in FIG. 3, the lines are arranged adjacently and each roller has two different diameter portions.

In a third embodiment, as shown in FIG. 4, the pump has adjacently arranged lines 5, 6 while in this case the internal wall of the fixed body 8 has a constant radius and each roller has a portion 23 of increased diameter so as to define (together with the internal wall of the fixed body 8,) adjacently arranged first and second interspaces; and more precisely, a first interspace defined by the surface *7a* and by the peripheral surface 23 of increased diameter of each roller having a cross-section of lesser thickness than the section of the second interspace defined by the second surface *7b* and the corresponding peripheral surface of the roller.

From the foregoing description, it is readily seen that a peristaltic pump can be produced to operate on two lines with different cross-sections and with different flow rates without requiring that the tubes have identical wall thicknesses and without complicated adjustments of the pump. The peristaltic pump thus conceived is susceptible to numerous modifications and variations, all within the scope of the inventive concept; furthermore all the details may be replaced with technically equivalent elements. In practice, the materials employed, as well as the dimensions, may be any according to the requirements and the state of the art.

I claim:

1. A peristaltic pump adapted to operate simultaneously on two different sized flexible fluid carrying lines having different wall thicknesses, comprising:

a fixed hollow body having a central axis and an interior with a generally cylindrically shaped wall surface and having at least one opening therein adapted to receive a first sized fluid line and a second sized fluid line along the wall surface;

a rotatable head having a generally cylindrically shaped periphery and arranged to be rotatable about the central axis within said hollow body;

at least one roller having a first diameter surface and a second diameter surface arranged to be rotatable about an axis parallel to the central axis near the periphery of said rotatable head, with a portion of the periphery of the first diameter surface and the second diameter surface extending beyond the periphery of said rotatable head and adapted to define first and second circular rolling path for progressively compressing the respective first sized fluid line and the second sized fluid line to simultaneously pump fluid through the respective lines.

* * * * *